United States Patent [19]

Herbst et al.

[11] Patent Number: 4,874,503

[45] Date of Patent: Oct. 17, 1989

[54] MULTIPLE RISER FLUIDIZED CATALYTIC CRACKING PROCESS EMPLOYING A MIXED CATALYST

[75] Inventors: Joseph A. Herbst, Turnersville; Hartley Owen, Belle Mead, both of N.J.; Paul H. Schipper, Wilmington, Del.

[73] Assignee: Mobil Oil Corporation, New York, N.Y.

[21] Appl. No.: 291,411

[22] Filed: Dec. 22, 1988

Related U.S. Application Data

[63] Continuation of Ser. No. 144,731, Jan. 15, 1988, abandoned, which is a continuation of Ser. No. 903,352, Sep. 3, 1986, abandoned.

[51] Int. Cl.[4] ..... C10G 57/00; C07C 2/02

[52] U.S. Cl. ..... 208/67; 208/70; 208/78; 208/79; 208/120; 208/155; 208/74; 585/322; 585/330; 585/407; 585/417; 585/533

[58] Field of Search ..... 208/67, 70, 78, 113, 208/155, 120, 79, 74; 585/322, 330, 533, 407, 415, 431, 417, 533

[56] References Cited

U.S. PATENT DOCUMENTS

| | | | |
|---|---|---|---|
| 3,617,497 | 11/1971 | Bryson et al. | 208/80 |
| 3,748,251 | 7/1973 | Demmel et al. | 208/74 |
| 3,849,291 | 11/1974 | Owen | 208/78 |
| 3,886,060 | 5/1975 | Owen | 208/77 |
| 3,891,540 | 6/1975 | Demmel et al. | 208/70 |
| 3,894,931 | 7/1975 | Nace et al. | 208/73 |
| 3,894,932 | 7/1975 | Owen | 208/74 |
| 3,894,933 | 7/1975 | Owen et al. | 208/77 |
| 3,894,934 | 7/1975 | Owen et al. | 208/78 |
| 3,894,935 | 7/1975 | Owen | 208/78 |
| 3,907,663 | 9/1975 | Owen | 208/100 |
| 3,915,840 | 10/1975 | Gladrow et al. | 208/53 |
| 3,926,778 | 12/1975 | Owen et al. | 208/74 |
| 3,928,172 | 12/1975 | Davis, Jr. et al. | 208/77 |
| 3,974,062 | 8/1976 | Owen et al. | 208/74 |
| 4,090,949 | 5/1978 | Owen et al. | 208/120 |
| 4,116,814 | 9/1978 | Zahner | 208/78 |
| 4,287,088 | 9/1981 | Sirkar | 208/52 CT |
| 4,309,279 | 1/1982 | Chester et al. | 208/120 |
| 4,368,114 | 1/1983 | Chester et al. | 208/120 |
| 4,426,276 | 1/1984 | Dean et al. | 208/70 |
| 4,591,425 | 5/1986 | Kovach et al. | 208/155 |
| 4,606,810 | 8/1986 | Krambeck et al. | 208/155 |
| 4,717,466 | 1/1988 | Herbst et al. | 208/120 |

*Primary Examiner*—Anthony McFarlane
*Attorney, Agent, or Firm*—A. J. McKillop; C. J. Speciale; R. D. Stone

[57] ABSTRACT

A catalytic cracking process is described featuring multiple risers in which a variety of hydrocarbon conversion reactions takes place, a stripping unit in which entrained hydrocarbon material is removed from catalyst and a regeneration zone in which spent cracking catalyst is regenerated, which comprises:

(a) converting a relatively high boiling hydrocarbon charge material in a first riser in the presence of a catalyst mixture comprising, as a first catalyst component, an amorphous cracking catalyst and/or a large pore crystalline cracking catalyst and, as a second catalyst component, a shape selective medium pore crystalline silicate to provide lighter products including naphtha and $C_3$ and/or $C_4$ olefin;

(b) converting an ethylene-rich charge material introduced to a second riser at a lower level thereof in the presence of said catalyst mixture to provide heavier products and to increase the temperature of the catalyst in said region; and, (c) converting $C_3$ and/or $C_4$ olefin introduced to the second riser at a higher level thereof in the presence of said catalyst mixture to provide a relatively high octane gasoline product.

22 Claims, 2 Drawing Sheets

MULTIPLE RISER FLUIDIZED CATALYTIC CRACKING PROCESS EMPLOYING A MIXED CATALYST

CROSS REFERENCE TO RELATED APPLICATIONS

This application is a continuation of copending patent application Ser. No. 144,731, filed on Jan. 15, 1988 and now abandoned which is a continuation of copending patent application Ser. No. 903,352, filed on Sept. 3, 1986 and now abandoned.

BACKGROUND OF THE INVENTION

This invention relates to a multiple riser catalytic cracking operation utilizing a mixture of amorphous cracking catalyst and/or large pore crystalline cracking catalyst, e.g., zeolite Y, and a shape selective medium pore crystalline silicate zeolite catalyst, e.g., zeolite ZSM-5.

In known and conventional fluidized catalytic cracking processes, a relatively heavy hydrocarbon feedstock, e.g., a gas oil, admixed with a suitable cracking catalyst, e.g., a large pore crystalline silicate zeolite such as zeolite Y, to provide a fluidized suspension is cracked in an elongated reactor, or riser, at elevated temperature to provide a mixture of lighter hydrocarbon products. The gasiform reaction products and spent catalyst are discharged from the riser into a separator, e.g., a cyclone unit, located within the upper section of an enclosed stripping vessel, or stripper, with the reaction products being conveyed to a product recovery zone and the spent catalyst entering a dense catalyst bed within the lower section of the stripper. In order to remove entrained hydrocarbon product from the spent catalyst prior to conveying the latter to a catalyst regenerator unit, an inert stripping gas, e.g., steam, is passed through the catalyst where it desorbs such hydrocarbons conveying them to the product recovery zone. The fluidized catalyst is continuously circulated between the riser and the regenerator and serves to transfer heat from the latter to the former thereby supplying the thermal needs of the cracking reaction which is endothermic.

Particular examples of such catalytic cracking processes are disclosed in U.S. Pat. Nos. 3,617,497, 3,894,932, 4,309,279 and 4,368,114 (single risers) and U.S. Pat. Nos. 3,748,251, 3,849,291, 3,894,931, 3,894,933, 3,894,934, 3,894,935, 3,926,778, 3,928,172, 3,974,062 and 4,116,814 (multiple risers).

Several of these processes employ a mixed catalyst system with each component of the system possessing different catalytic properties and functions. For example, in the dual riser hydrocarbon conversion process described in U.S. Pat. No. 3,894,934, a heavy hydrocarbon first feed, e.g., a gas oil, is cracked principally as a result of contact with a large pore crystalline silicate zeolite cracking catalyst, e.g., zeolite Y, to provide lighter products. Spent catalyst is separated from the product stream and enters the dense fluid catalyst bed in the lower section of the stripping vessel. A $C_3$-rich second feed, meanwhile, undergoes conversion to cyclic and/or alkylaromatic hydrocarbons in a second riser, principally as a result of contact with a shape selective medium pore crystalline silicate zeolite, e.g., zeolite ZSM-5. Spent catalyst recovered from the product stream of the second riser similarly enters the dense catalyst bed within the stripper vessel. U.S. Pat. No. 3,894,934 also features the optional introduction of a $C_3$-containing hydrocarbon third feed along with an aromatic-rich charge into the dense fluid bed of spent catalyst above the level of introduction of the stripping gas to promote the formation of alkyl aromatics therein. As desired, the third feed may be light gases obtained from a fluid cracking light ends recovery unit, virgin straight run naphtha, catalytically cracked naphtha, thermal naphtha, natural gas constituents, natural gasoline, reformates, a gas oil, or a residual oil of high coke-producing characteristics.

The dual riser catalytic cracking process described in U.S. Pat. No. 3,928,172 utilizes a mixture of a large pore crystalline silicate zeolite cracking catalyst, e.g., zeolite REY, and a shape selective medium pore crystalline silicate zeolite, e.g., ZSM-5. According to this process, a gas oil is cracked in a first riser in the presence of the aforesaid catalyst mixture, principally as a result of the zeolite REY component thereof, to provide a heavy naphtha product, the latter being recracked and/or a virgin straight run naphtha being cracked in a second riser in the presence of the catalyst mixture to provide a higher octane gasoline product together with varying quantities of $C_3$ and $C_4$ olefins.

SUMMARY OF THE INVENTION

It is an object of the invention to provide a fluid catalytic cracking operation featuring at least two riser reaction zones, at least one stripping zone and at least one catalyst regeneration zone employing a mixed catalyst system comprising, as a first catalyst component, an amorphous cracking catalyst and/or a large pore crystalline cracking catalyst and, as a second catalyst component, a shape selective medium pore crystalline silicate zeolite catalyst.

It is a particular object of the present invention to carry out a fluidized catalytic cracking operation employing said mixed catalyst system in which a heavy hydrocarbon feed, e.g., gas oil and/or resid, is cracked in a first riser reaction zone, due to the presence of both the first and the second catalyst component, to provide lighter products including significant quantities of naphtha and light olefins, ethylene is converted in the lower region of a second riser, primarily due to the presence of the second catalyst component, to provide higher molecular weight products including light olefins, aromatics, etc., and to simultaneously increase the temperature of the catalyst bed in said region and a light olefin co-feed is converted in a higher region of the second riser to provide a relatively high octane gasoline product.

It is still another object of the invention to convert a heavy hydrocarbon feed to a high octane gasoline product in a dual riser catalytic cracking unit wherein different physical characteristic(s) of the first and second catalyst components permits separation, or segregation, of the catalyst components within a common stripping vessel and/or a prolongation of the residency time of the second catalyst component within one of the risers, the net result being a capability for reducing the rate of circulation of the less coke deactivated second catalyst component through the regeneration zone, and consequently, a conservation of its catalytic activity.

In keeping with the foregoing objects, there is provided a catalytic cracking operation featuring multiple risers in which a variety of hydrocarbon conversion reactions take place, a stripping unit in which entrained hydrocarbon material is removed from catalyst and a regeneration zone in which spent cracking catalyst is regenerated, which comprises:

(a) converting a relatively high boiling hydrocarbon charge material in a first riser in the presence of a catalyst mixture comprising, as a first catalyst component, an amorphous cracking catalyst and/or a large pore crystalline cracking catalyst and, as a second catalyst component, a shape selective medium pore crystalline silicate to provide lighter products including naphtha and $C_3$ and/or $C_4$ olefin;

(b) converting an ethylene-rich charge material introduced to a second riser at a lower level thereof in the presence of said catalyst mixture to provide heavier products and to increase the temperature of the catalyst in said region; and, (c) converting $C_3$ and/or $C_4$ olefin introduced to the second riser at a higher level thereof in the presence of said catalyst mixture to provide a relatively high octane gasoline product.

The term "catalyst" as used herein shall be understood to apply not only to a catalytically active material but to one which is composited with a suitable matrix component which may or may not itself be catalytically active.

Temperature control within each riser, and therefore the nature of the principal conversion products produced therein, can be achieved by controlling the quantities of catalyst transferred thereto from the stripping unit and/or regenerator and, in the case of the second riser, by controlling the quantity of the ethylene-rich feed. As a result of such temperature control, and by suitable regulation of the catalyst contact times, it is possible to operate the process so as to maximize the overall conversion of feed to high octane gasoline or, if desired, the production of light olefins (at some expense to gasoline quality and yield) such as $C_3$ and/or $C_4$ olefins for use in alkylation reactions.

DESCRIPTION OF THE PREFERRED EMBODIMENTS

Figure 1:
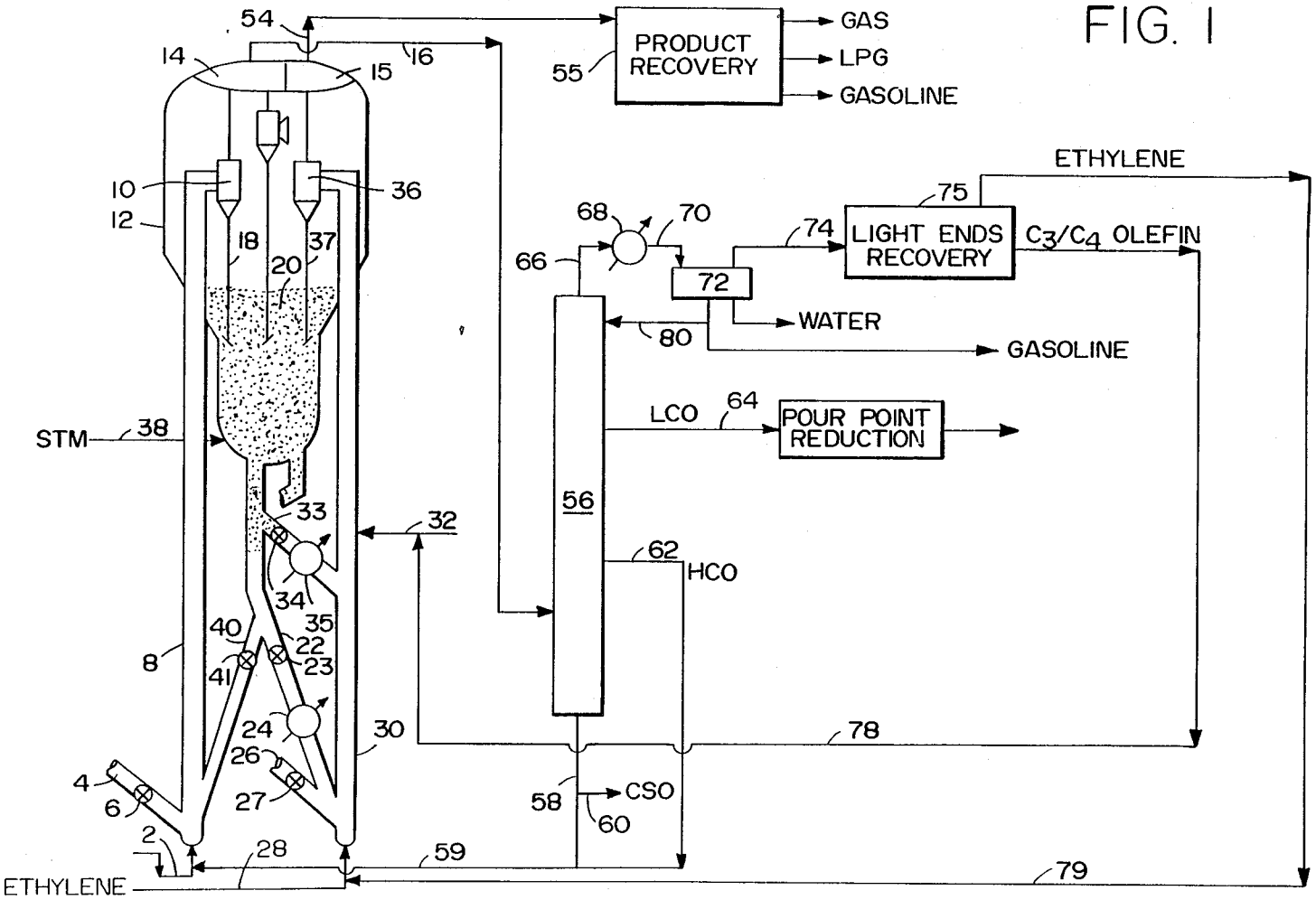
FIG. 1 schematically illustrates a fluidized catalytic cracking operation in accordance with this invention; and, FIG. 2 schematically illustrates another type of fluidized catalytic cracking operation of the present invention wherein the stripping unit features means for separating the first and second catalyst components based primarily on differences in their average particle sizes and densities, such arrangement making it possible to cycle the second catalyst component without exposing it to the catalyst-degrading conditions of the regenerator.

Conventional cracking catalyst components are generally amorphous silica-alumina and crystalline silica-alumina. Other materials said to be useful as cracking catalysts are the crystalline silicoaluminophosphates of U.S. Pat. No. 4,440,871 and the crystalline metal aluminophosphates of U.S. Pat. No. 4,567,029.

However, the major conventional cracking catalysts presently in use generally comprise a large pore crystalline silicate zeolite, generally in a suitable matrix component which may or may not itself possess catalytic activity. These zeolites typically possess an average crystallographic pore dimension of about 7.0 angstroms and above for their major pore opening. Representative crystalline silicate zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), merely to name a few, as well as naturally occurring zeolites such as chabazite, faujasite, mordenite, and the like. Also useful are the silicon-substituted zeolites described in U.S. Pat. No. 4,503,023. Zeolite Beta is yet another large pore crystalline silicate which can constitute a component of the mixed catalyst system utilized herein.

It is, of course, within the scope of this invention to employ two or more of the foregoing amorphous and/or large pore crystalline zeolite cracking catalysts as the first catalyst component of the mixed catalyst system. Preferred crystalline zeolite components of the mixed catalyst system herein include the natural zeolites mordenite and faujasite and the synthetic zeolites X and Y with particular preference being accorded zeolites Y, REY, USY and RE-USY.

The shape selective medium pore crystalline silicate zeolite catalyst constituting the second catalyst component of the mixed catalyst system is exemplified by ZSM-5, ZSM-11, ZSM-12, ZSM-23, ZSM-35, ZSM-38 and other similar materials. U.S. Pat. No. 3,702,886 describing and claiming ZSM-5 is incorporated herein by reference. Also, U.S. Reissue Patent No. 29,948 describing and claiming a crystalline material with an X-ray diffraction pattern of ZSM-5, is incorporated herein by reference as is U.S. Pat. No. 4,061,724 describing a high silica ZSM-5 referred to as "silicalite" therein.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

ZSM-48 is more particularly described in U.S. Pat. No. 4,375,573, the entire contents of which are incorporated herein by reference.

The preferred shape selective crystalline silicate zeolites of the mixed catalyst system herein are ZSM-5, ZSM-11, ZSM-12, ZSM-23, ZSM-35, ZSM-38 and ZSM-48 with ZSM-5 being particularly preferred.

In general, the aluminosilicate zeolites are effectively employed herein. However, zeolites in which some other framework element is present in partial or total substitution of aluminum can be advantageous. For example, such catalysts may provide a higher conversion of feed to aromatic components, the latter tending to increase the octane, and therefore the quality, of the gasoline produced in the process. Illustrative of elements which can be substituted for part or all of the framework aluminum are boron, gallium, titanium and any other trivalent metal which is heavier than aluminum. Specific examples of such catalysts include ZSM-5 and zeolite Beta containing boron, gallium and/or titanium. In lieu of, or in addition to, being incorporated into the zeolite framework, these and other catalytically active elements can also be deposited upon the zeolite by any suitable procedure, e.g., impregnation.

In known and conventional fluidized catalytic cracking operations employing mixtures of large and medium pore size crystalline silicate zeolite catalysts where catalyst separated from the product effluent is conveyed to a stripper and from there to a catalyst regenerating zone, regardless of the nature of the catalyst introduction at start-up, once steady-state operation has been achieved, the two types of catalyst will become fairly uniformly mixed and will circulate throughout the system at or about the same rate. This arrangement is subject to a significant disadvantage. While the large pore zeolite cracking catalyst cokes up relatively quickly and must therefore be regenerated at frequent intervals, this is not the case with the medium pore zeolite catalyst which can maintain their catalytic activity over many more cycles of operation. However, since the large and medium pore zeolite catalyst are in intimate admixture, heretofore there has been no practical means of conveying only the large pore zeolite catalyst to the catalyst regenerator unit or, what amounts to the same thing, keeping the medium pore zeolite catalyst, or at least most of it, on the average out of the regenerator.

Thus, a principal disadvantage resulting from the use of mixed catalyst systems in known fluidized catalytic cracking operations is owing to the fact that the medium pore zeolite catalyst component is subjected to the harsh hydrothermal conditions of the catalyst regenerator unit even though it does not require regeneration anywhere near the rate at which the large pore zeolite catalyst cracking component must be regenerated. The medium pore zeolite catalyst is therefore needlessly subjected to hydrothermal deactivation at a much greater rate than is necessary for it to function.

Separating the mixed catalyst system into its first and second catalyst components does much to overcome this drawback. Thus, once particles of first component are separated from particles of second component, the former can be conveyed to the regenerator while the latter can be cycled directly back to the appropriate riser thereby avoiding passing through the regenerator. Such separation can precede or follow stripping of the catalyst components. As applied, for example, to a fluidized catalyst cracking process in which a cracking catalyst requiring frequent regeneration such as zeolite Y is employed in combination with a shape selective medium pore crystalline silicate zeolite catalyst requiring relatively infrequent regeneration such as ZSM-5, the present invention makes it possible to sustain relatively high levels of activity of the latter catalyst for much longer average periods than would otherwise be the case due to the reduced incidence of its exposure to the catalyst-degrading environment of the regenerator zone. This in turn, permits the refiner to take greater advantage of the unique catalytic capabilities of ZSM-5 in a catalytic cracking operation.

Separation of particles of first catalyst component from particles of second catalyst component in the stripper unit can be accomplished in several ways. For example, the two components can be provided in such different average particle sizes that they can be readily sorted within a stripping unit possessing suitable sieving means, an arrangement more particularly described in connection with the dual riser fluidized catalytic cracking unit illustrated in FIG. 2, infra.

Separation within the stripping zone can also be achieved by classifying the first and second catalyst components according to their average particle densities which can be made to be significantly different in various ways including by appropriate selection of the matrix components with which they are composited as more fully explained below. In general, smaller, less dense catalyst particles will tend on the average to define an upper phase within the stripper floating upon larger, more dense catalyst particles which, conversely, will tend on the average to define a lower phase within the stripper.

It is also within the scope of this invention to impart such different physical characteristic(s) to the first and second catalyst components that they each will exhibit different settling rates, designated $R_1$ and $R_2$ respectively, which permit the catalyst particles having the greater settling rate to remain within a riser reaction zone longer than the catalyst particles having the lower settling rate. Preferably, the second catalyst component, i.e., the less coke deactivated one, is given a higher settling rate as to reside in the second riser for a longer period of time than the first catalyst component.

Residency time of catalyst particles in a riser is primarily dependent on two factors: the linear velocity of the fluid stream within the riser which tends to carry the entire catalyst bed/conversion products/unconverted feed up and out of the riser into the separator unit and the opposing force of gravity which tends to keep the slower moving catalyst particles within the riser. Ordinarily, in a mixed catalyst system, both catalyst components will circulate through the system at about the same rate. As previously pointed out, this has proven disadvantageous to the efficiency of the system since the medium pore zeolite catalyst or other catalyst component which does not require as frequent regeneration as the cracking catalyst will be needlessly subjected to the catalyst-degrading conditions of the regenerator with the result that its useful catalytic life will be shortened. However, in accordance with this invention, it is possible to retain the less coke deactivated catalyst within the riser, even to the point where, because of a balance between the upward velocity of this catalyst component and its settling rate, it can be made to remain more or less stationary, or suspended, at any desired level within the riser defining a zone of concentration therein. To bring about this balance or to otherwise prolong the residency time of a particular component of the mixed catalyst system within the riser, the average density, particle size and/or shape of the catalyst particles can be adjusted in a number of ways as to provide the desired settling characteristics. As a general guide, as the average particle size of the catalyst increases and/or its average particle density increases, the residency time of the catalyst will increase.

Assuming, for example, this differential in $R_1$ and $R_2$ is accomplished by making the particles of the second catalyst component initially larger and of greater density than the particles of first catalyst component and perhaps even more irregular in shape than the latter, gradual attrition of the larger particles (through particle collision) will progressively reduce their capability for prolonged residency in the riser and as time goes on, increasing quantities of such particles will enter the stripping zone where, however, they can still be readily separated based on their different densities as later more fully explained. This arrangement, i.e., increased residency time in the riser coupled with separation in the stripping zone, maximizes the capability of the catalytic cracking process of this invention for reducing the rate of circulation of the less coke deactivated catalyst particles through the regenerator zone.

Among the techniques which can be used for making one catalyst component more dense than the other is compositing each catalyst with a matrix component of substantially different density. Useful matrix components include the following:

| matrix component | particle density (gm/cm$^3$) |
|---|---|
| alumina | 3.9–4.0 |
| silica | 2.2–2.6 |
| magnesia | 3.6 |
| beryllia | 3.0 |
| barium oxide | 5.7 |
| zirconia | 5.6–5.9 |
| titania | 4.3–4.9 |

Combinations of two or more of these and/or other suitable porous matrix components, e.g., silica-alumina, silica-magnesia, silica-thoria, silica-alumina-zirconia, etc., can be employed for a still wider spectrum of density values from which one may select a specific predetermined value as desired.

In general, selection of each matrix component will be such that the catalyst which is to have the lower rate of circulation through the regenerator will be more dense than the catalyst requiring frequent regeneration. For example, in the case of a mixed catalyst system containing medium pore and large pore crystalline silicate zeolite catalysts where it is desired to increase the residency time of the medium pore zeolite catalyst in the riser, the overall packed density of the medium pore zeolite catalyst particles inclusive of its matrix component can advantageously vary from about 0.6 to about 4.0 gm/cm$^3$, and preferably from about 2.0 to about 3.0 gm/cm$^3$, and the overall packed density of the large pore zeolite catalyst particles inclusive of its matrix component can advantageously vary from about 0.4 to about 1.1 gm/cm$^3$ density, and preferably from about 0.6 to about 1.0 gm/cm$^3$.

Another useful technique for adjusting the density of each catalyst component, again in the case of a mixture of medium and large pore zeolites, is to composite the medium pore zeolite catalyst particles with a material which tends to coke up faster than the particles of large pore zeolite catalyst, such resulting in an increase in the density of the former in situ. Illustrative of such materials are hydrated alumina which in situ forms a transition alumina which has a rapid coking rate. This embodiment possesses several additional advantages. In the coked-up state, the composited medium pore silicate zeolite catalyst is more resistant to attrition which results from collision with other particles in the riser. The individual catalyst particles can sustain more collisions and thus serve as a practical means of adjusting the velocity of the large pore zeolite catalyst particles through the riser (the latter in colliding with the medium pore zeolite catalyst particles will, as a result, have reduced velocity). In addition, the coked-up composited medium pore zeolite catalyst particles will tend to accumulate metals present in the feed.

As previously stated, the relative settling rate of each catalyst component can be selected by varying the average particle size of the catalyst particles. This can be readily accomplished at the time of compositing the catalyst particles with various matrix components. As between two catalyst components of significantly different average particle size, the larger will tend to remain within the riser longer than the smaller. Where it is desired to increase the residency time, say, of the medium pore zeolite catalyst particles in the riser over that of the large pore zeolite catalyst component, the average particle size of the former will usually be larger than that of the latter. So, for example, the average particle size of the medium pore zeolite catalyst particles can be made to vary from about 500 microns to about 70,000 microns, and preferably from about 1000 to about 25,000 microns while the average particle size of the large pore zeolite catalyst particles can be made to vary from about 20 to about 150 microns, and preferably from about 50 to about 100 microns.

The shape, or geometric configuration, of the catalyst particles also affects their relative settling rates, the more irregular the shape (i.e., the more the shape deviates from a sphere), the longer the residency time of the particles in the riser. Irregular-shaped particles can be simply and readily achieved by crushing the catalyst-matrix extrudate or using an extruded catalyst.

As will be appreciated by those skilled in the art, the settling rate for a particular catalyst component will result from the interaction of each of the three foregoing factors, i.e., density, average particle size and particle shape. The factors can be combined in such a way that they each contribute to the desired result. For example, the particles of the less coke deactivated catalyst can simultaneously be made denser, larger and more irregular in shape than the catalyst particles requiring frequent regeneration. However, a differential settling rate can still be provided even if one of the foregoing factors partially offsets another as would be the case where greater density and smaller average particle size coexist in the same catalyst particle. Regardless of how these factors of particle density, size and shape are established for a particular catalyst component, their combined effect will, of course, be such as to result in a significant differential in settling rates of the components comprising the mixed catalyst system of this invention.

By varying the cross sectional geometry of the riser, it is possible to further prolong the residency time therein of the denser, larger and/or more irregularly shaped catalyst particles. Numerous geometric configurations can be utilized to achieve this effect. So, for example, the riser can be made to flare outwardly for a part of its length. In one such arrangement, some portion of the upper section of the riser can be flared outwardly. The denser, larger and/or more irregularly shaped particles will tend to occupy the flared region of the riser as to constitute a zone of concentration therein.

The shape selective medium pore crystalline silicate zeolite catalyst can be present in the mixed catalyst system over widely varying levels. For example, the zeolite in the second catalyst component can be present at a level as low as about 0.01 to about 1.0 weight percent of the total catalyst inventory (as in the case of the catalytic cracking process of U.S. Pat. No. 4,368,114) and can represent as much as 25 weight percent of the total catalyst system.

Suitable charge stocks for cracking in the first riser comprise the hydrocarbons generally and, in particular, petroleum fractions having an initial boiling point range of at least 400° F., a 50% point range of at least 500° F. and an end point range of at least 600° F. Such hydrocarbon fractions include gas oils, thermal oils, residual oils, cycle stocks, whole top crudes, tar sand oils, shale oils, synthetic fuels, heavy hydrocarbon fractions derived from the destructive hydrogeneration of coal, tar, pitches, asphalts, hydrotreated feedstocks derived from any of the foregoing, and the like. As will be recognized, the distillation of higher boiling petroleum fractions above about 750° F. must be carried out under vacuum in order to avoid thermal cracking Referring to FIG. 1, a gas oil/resid feed is introduced to the cracking unit by conduit 2 where it is combined with hot regenerated catalyst comprising zeolite Y catalyst in admixture with ZSM-5 in conduit 4 containing flow control valve 6 to form a suspension of catalyst particles in oil vapors which pass upwardly through first riser reactor 8. The conversion conditions within first riser 8 can be varied depending upon whether it is desired to maximize production of naphtha or light olefins, principally $C_3$ and $C_4$ olefins but including some ethylene as well. Shifting of varying amounts of stripped, non-regenerated catalyst mixture from the stripper to riser 8 through conduit 40 provided with flow control valve 41 permits regulation of the active ZSM-5 concentration in the riser and assists in maintaining control of the temperature therein. When it is desired to emphasize the production of naphtha, the ZSM-5 zeolite concentration in the second catalyst can represent from about 0.1 to about 6, and preferably from about 0.2 to about 5.0, weight percent of the total catalyst mixture and the temperature can range from about 900° to about 1150° F. and preferably from about 925 to about 1000° F., the catalyst to oil ratio can range from about 3:1 to about 20:1 and preferably from about 4:1 to about 10:1 and the catalyst contact time can range from about 0.5 to about 30 seconds and preferably from about 1 to about 15 seconds. When, however, light olefin production (at the expense of naphtha) is desired, the ZSM-5 zeolite concentration in the second catalyst can comprise from about 1 to about 25, and preferably from about 2 to about 10, weight percent of the catalyst mixture, the temperature, catalyst to oil ratio and catalyst contact time being selected from the aforementioned ranges. During passage of the suspension through the riser, conversion of the gas oil feed to lower boiling products occurs. These products are separated after removal of catalyst therefrom in a cyclone separator 10 housed in the upper portion of vessel 12. Separated hydrocarbon vapors pass into plenum chamber 14 and are removed therefrom by conduit 16 for separation in downstream operations. Catalyst separated in cyclone 10 is conveyed by dipleg 18 into a bed of catalyst 20 therebelow. In fractionation zone 56, a separation of the products of conversion from riser 8 is made to recover main column bottoms (MCB) from the bottom of the fractionator by conduit 59 communicating with conduit 2 for recycle to riser 8 as desired. On the other hand, the main column bottoms may be withdrawn by conduit 60 for other use. A heavy cycle oil (HCO) is withdrawn by conduit 62 for recycle by conduit 59 to riser 8. A light cycle oil (LCO) product is withdrawn by conduit 64. An overhead fraction lower boiling than the light cycle oil and comprising gasoline and lower boiling hydrocarbons are withdrawn from an upper portion of fractionator 56 by conduit 66. The withdrawn material in conduit 66 passes through cooler 68 and conduit 70 to knockout drum 72 wherein condensed liquids such as water and gasoline boiling material are separated from lower boiling gaseous components. The low boiling gaseous components are withdrawn by conduit 74 for passage to a light ends recovery operation 75 wherein a separation is made to recover, for example, $C_3$ and/or $C_4$ olefins for recycle to an upper region of second riser 30 through conduits 78 and 32. In addition, ethylene is recovered from the light ends units (as indicated by 75) and is recycled through conduit 79 to conduit 28 to bottom of the second riser 30. A gasoline boiling range fraction separated in drum 72 is recycled by conduit 80 as reflux to the fractionator tower.

It is contemplated passing hot, stripped catalyst mixture from the lower section of vessel 12 by conduit 22 provided with valve means 23 and cooler 24 substantially directly to the inlet of a second riser reactor 30. In another embodiment, only freshly regenerated catalyst is passed to the inlet of second riser 30 a by conduit 26 equipped with valve means 27 or a mixture of catalyst obtained from conduits 22 and 26 may be introduced to riser 30. In any event, an ethylene-rich stream is introduced by conduit 28 to a lower region of second riser 30 for admixture with catalyst introduced as above described to form a suspension. The ethylene charge material, which generally contains at least about 10, and preferably at least about 20, weight percent ethylene (the balance being made up largely of highly reactive light olefins such as propylene and/or butylenes) and includes an essentially pure ethylene feed, is advantageously recycled from riser 8 via conventional light ends recovery through conduit 79 to the bottom of riser 30. The conditions of conversion of the ethylene-rich feed in the lower section of riser 30 can include a temperature of from about 400° to about 750° F. and preferably from about 500 to about 650° F., a catalyst to oil ratio of from about 5:1 to about 40:1 and preferably from about 20:1 to about 30:1 and a catalyst contact time of from about 10 to about 90 seconds and preferably from about 50 to about 70 seconds. The ZSM-5 zeolite concentration of the total catalyst mixture can vary from about 1 to about 25 weight percent, and preferably from about 2 to about 10 weight percent, thereof. The relatively high partial pressure of ethylene permits its maximum conversion in the lower section of riser 30 to a variety of other products. A typical conversion product profile for the conversion of ethylene in the lower section of riser 30 is as follows:

| Product | Weight Percent |
|---|---|
| $C_5$+ (includes paraffins, olefins, aromatics, naphthenes, etc.) | 73.0 |
| pentanes | 14.8 |
| n-butane | 1.6 |
| isobutane | 4.6 |
| butene | 6.5 |
| propane | 2.5 |
| propylene | 2.3 |
| ethane | 0.6 |
| ethylene | 8.8 |
| methane | 0.1 |

The conversion reaction, which is exothermic, increases the temperature of the catalyst prior to contact with the $C_3$ and/or $C_4$ olefins introduced further up the riser thereby providing conditions conducive to maximum production of relatively high octane gasoline for a given quantity of feed. This conversion of ethylene-rich feed also serves to pre-accelerate the suspension in the lower region of the riser thereby providing uniform catalyst distribution across the riser prior to contact with the $C_3$ and/or $C_4$ olefin feed further up the riser.

As the catalyst-hydrocarbon suspension formed in the lower region of second riser 30 continues to ascend therein, it is combined with a $C_3$ and/or $C_4$ olefin-rich feed further up the riser introduced through conduit 32. Advantageously, this feed is one which has been recovered from the light ends fraction produced in first riser 8 and recycled through line 78. Temperature within this upper region of the second riser and other factors influencing the nature of the conversion occurring therein can be controlled by adjusting the quantity of stripped, non-regenerated catalyst mixture introduced therein through conduit 33 provided with control valve 34 and cooler 35. The non-regenerated catalyst mixture, while having little non-selective cracking activity remaining (due to the essentially spent condition of the zeolite Y component), retains much of its shape selective activity (attributable to the ZSM-5 component). Depending upon its temperature, the catalyst mixture can serve as a quench to reduce the temperature in the upper region of the second riser to the point where more oligomerization and less aromatization will result. In general, lower temperatures favor higher liquid recovery at, however, the expense of octane number of the gasoline product. Conversely, higher temperatures favor increased aromatization but greater gas production (e.g., hydrogen, methane and some other light paraffins) with consequent lower liquid recovery but with a beneficial increase in the octane number of the gasoline product. In general, the temperature within the upper region of riser 30 can be maintained within range of from about 400° to about 750° F., preferably from about 500 to about 650° F., a catalyst to $C_3$ and/or $C_4$ olefin feed ratio of from about 5:1 to about 40:1, preferably from about 20:1 to about 30:1 and a catalyst contact time of from 5 to about 45 seconds, preferably from about 25 to about 35 seconds. The hydrocarbon product/catalyst stream continues upwardly within riser 30 to be discharged into cyclone separator 36 provided with dipleg 37 in the upper portion of vessel 12. Catalyst discharged from diplegs 18 and 37 is collected in the lower portion of vessel 12 as a fluid bed of catalyst particles 20 moving generally downwardly through the vessel and through a stripping zone provided in the lowermost portion of vessel 12. Stripping gas, e.g., steam, is added to the lower portion of the stripping zone by conduit 38.

Catalyst particles comprising particularly the zeolite Y cracking component of the mixed catalyst system herein accumulate a relatively high level of entrained hydrocarbonaceous material therein which is subsequently removed by regeneration with oxygen-containing regeneration gases in a catalyst regeneration unit (not shown) of known design and operation.

The products of conversion from riser 30 are passed to plenum chamber 15 and are removed therefrom by conduit 54 communicating with a conventional product recovery unit 55.

Figure 2:
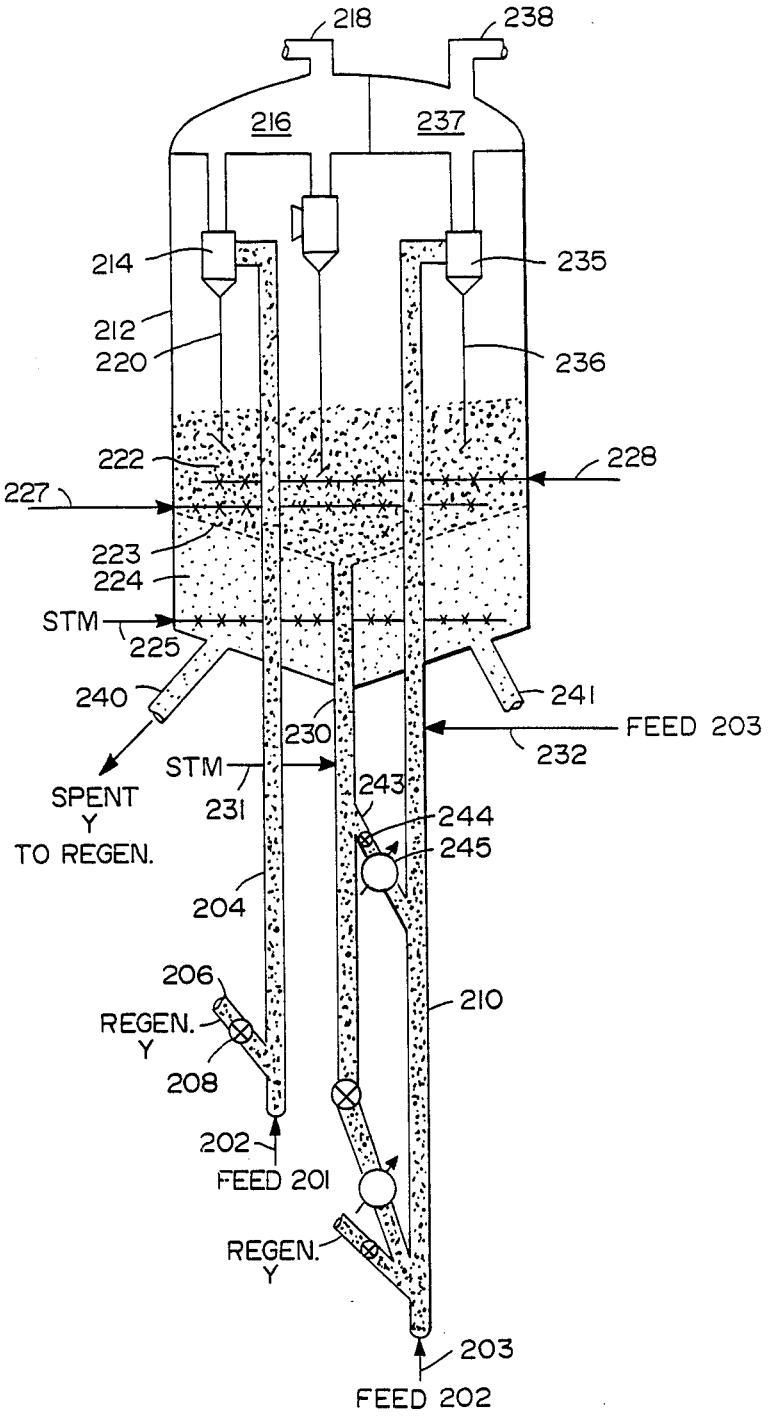

FIG. 2 is illustrative of a dual riser fluid catalytic cracking operation featuring separation of the catalyst components in the stripper in accordance with a preferred embodiment of the process of this invention. Both risers can be operated in accordance with the conditions described above in connection with the embodiment of FIG. 1. A gas oil feed (Feed 201) is introduced to first riser 204 by conduit 202 and is combined with hot regenerated zeolite Y cracking catalyst in conduit 206 containing flow control valve 208 to form a suspension of catalyst particles in oil vapors which pass upwardly through the riser. The individual particles of zeolite Y catalyst are appreciably smaller and less dense than the particles of ZSM-5 catalyst which is also utilized in the conversion process. Riser 204 discharges directly into a cyclone separator 214 housed in the upper portion of vessel 212. In cyclone separator 214, hot cracking catalyst is separated from hydrocarbon product of cracking. Separated hydrocarbon vapors pass into plenum chamber 216 and are removed therefrom by conduit 218 for separation in downstream equipment (not shown). Spent cracking catalyst separated in cyclone 214 is conveyed by dipleg 220 into catalyst bed 222. A conically shaped perforate plate or sieve 223 separates the larger, denser ZSM-5 catalyst particles from the zeolite Y catalyst particles, the latter passing through the sieve to the lower section 224 of the stripping zone. Stripping gas, in this case steam, is introduced through conduit 225 where it removes entrained hydrocarbon material from both catalyst components. The ZSM-5 catalyst particles gravitate toward the bottom of sieve 223 and eventually enter return conduit 230 provided with a source of low pressure steam 231 which blows smaller, less dense catalyst particles of zeolite Y which may have become entrained with the ZSM-5 catalyst particles back up into catalyst bed 222. Zeolite Y catalyst particles entering lower section 224 of the stripper zone are, following stripping, conveyed through one or more conduits 240 and 241 to the catalyst regeneration zone. Following regeneration, the zeolite Y is reintroduced to first riser 204 and/or second riser 210.

In second riser 210, a suspension of ZSM-5 catalyst of larger particle size and greater density than the zeolite Y catalyst particles and an ethylene-rich feed (Feed 202) introduced into the lower section of the riser through conduit 203 is caused to be formed. The suspension of catalyst and hydrocarbon vapors continues to move upwardly through riser 210 where it is combined with a $C_3$ and/or $C_4$ olefin-rich feed (Feed 203) introduced through conduit 232. Additional ZSM-5 catalyst particles can be injected up the riser through conduit 243 with control valve 244. The catalyst stream can control the temperature in the upper portion of the riser 210 by utilizing an optimal catalyst cooler 245. The suspension is eventually discharged into one or more cyclonic separators 235 provided with dipleg 236. Separated catalyst enters bed 222 where it is separated into its ZSM-5 and zeolite Y catalyst components by the aforedescribed sieving operation, the conversion products meanwhile being combined with the other gaseous streams in plenum chamber 237 for transfer through conduit 238 to a downstream separation facility (not shown).

In order to enhance the overall efficiency of the operation, a light olefin feed, e.g., a gas rich in ethylene, can be introduced into the lower section of catalyst bed 222 containing a concentration of ZSM-5 catalyst particles through conduit 227 to produce higher weight products and an exotherm which improves the absorption efficiency of the striping operation. In general, the quantity of light olefin feed should be such as to increase the temperature of the catalyst bed in this region by at least about 50° F., and preferably by at least about 100° F. To accomplish this, from about 0.5 to abut 20, and preferably from about 1 to about 10, weight percent of light olefin feed can be introduced into this phase by weight of total catalyst present in the stripper. Ordinarily, then, the temperature of the catalyst bed will increase from its usual range of about 880°–1150° F. to about 930°–1250°

F. and even higher. This increase in spent catalyst bed temperature significantly enhances the stripping, or desorption, of hydrocarbons and, where present sulfur compounds, which are entrained by the catalyst particles. Thus, in carrying out the foregoing improved stripping process, it is possible to increase the recovery of such entrained hydrocarbons by from about 5 to about 30 weight percent or more compared to substantially the same stripping procedure carried out in the absence of the exothermic conversion reaction herein. Optionally, where the light olefin feed in line 227 is predominantly made up of ethylene, one or more other highly reactive light olefins, e.g., propylene, butylene or mixtures thereof, can be introduced into the lower catalyst phase through a separate conduit 228 in order to take advantage of the higher partial pressure of the ethylene contained in the feed stream introduced through line 227 located therebelow. Amounts of $C_3$ and/or $C_4$ olefin material ranging from about 0.1 to about 5, and preferably from about 0.2 to about 3, weight percent of the entire catalyst bed can be suitably employed.

From the foregoing, it will be appreciated that due to the separation of ZSM-5 catalyst particles from zeolite Y catalyst particles in the stripper, it is possible to have much of the ZSM-5 catalyst bypass the regenerator altogether. As a result, the ZSM-5 catalyst particles are retained in the catalyst inventory at a higher level of activity therein for a longer average period of time than would be the case were they to circulate through the system more or less together with the zeolite Y catalyst particles.

Having thus provided a general discussion of the present invention and described specific embodiments in support thereof, it is to be understood that no undue restrictions are to be imposed by reason thereof except as provided by the following claims.

What is claimed is:

1. A fluidized catalytic cracking (FCC) process for cracking in a first riser reactor a heavy feed to cracked products comprising lighter products including light olefins comprising ethylene, and olefinic gasoline over a catalyst mixture comprising a FCC catalyst and a shape selective zeolite additive said process characterized by:

(a) recovering as a product the gasoline fraction produced by riser cracking of the heavy feed in the first riser;

(b) recovering an ethylene rich charge material consisting essentially of catalytically cracked products and comprising at least 10 weight percent ethylene and the balance comprising propylene and butylene and mixtures thereof;

(c) separately recovering a light olefinic feed with a higher boiling point than the ethylene rich material, comprising $C_3$ and $C_4$ olefins and mixtures thereof;

(d) contacting in the base of a second riser reactor a feed consisting essentially of the ethylene rich charge material with the FCC catalyst and shape selective zeolite additive at a temperature of 400°–750° F.;

(e) converting in an exothermic conversion reaction a majority of the ethylene rich charge material in the base of the second riser to $C_5$+as an intermediate product;

(f) contacting the mixture of $C_5$+*intermediate product and catalyst with the light olefinic feed comprising* $C_3$ and $C_4$ olefins and mixtures thereof;

(g) reacting the $C_5^{30}$ intermediate product with the light olefinic feed to form high octane gasoline which is discharged from the second riser.

2. The process of claim 1 wherein the ethylene-rich charge material is essentially pure ethylene.

3. The process of claim 1 wherein the FCC catalyst comprises a large pore zeolite selected from the group consisting of zeolite X, Y, REY, USY, RE-USY, mordenite and mixtures thereof.

4. The process of claim 1 wherein the shape selective zeolite additive is selected from the group consisting of ZSM-5, ZSM-11, ZSM-12, ZSM-23, ZSM-35, ZSM-38 and ZSM-48.

5. The process of claim 3 wherein, the first riser, the shape selective zeolite additive is about 0.1 to about 10 weight percent of the total catalyst mixture, the first riser operates at reaction conditions including a temperature of about 900 to about 1150 F., a catalyst to oil ratio of about 3:1 to about 20:1 and a catalyst contact time of about 0.5 to about 30 seconds.

6. The process of claim 5 wherein the shape selective zeolite additive is about 0.2 to about 5.0 weight percent of the catalyst mixture, the temperature is about 925 ° to about 1000° F., the catalyst to oil ratio is about 4:1 to about 10:1 and the catalyst contact time is about 1 to about 15 seconds.

7. The process of claim 3 wherein, in the first riser, the shape selective zeolite additive is about 1 to about 25 weight percent of the total catalyst mixture, the first riser operates at reaction conditions including a temperature of about 900 to about 1150 F., a catalyst to oil ratio of about 3:1 to about 20:1 and a catalyst contact time of about 0.5 to about 30 seconds.

8. The process of claim 7 wherein the shape selective zeolite additive is about 2 to about 10 weight percent of the total catalyst mixture.

9. The process of claim 1 wherein the second riser has a lower region above the base and in the lower region of the second riser, the shape selective zeolite additive is about 1 to about 25 weight percent of the catalyst mixture and reaction conditions in said lower region include a temperature of about 400 to about 750 F., a catalyst to hydrocarbon ratio of about 5:1 to about 40:1 and a catalyst contact time of about 10 to about 90 seconds.

10. The process of claim 9 wherein the shape selective zeolite additive is about 2 to about 10 weight percent of the total catalyst mixture, the temperature is from 500° to about 650° F., the catalyst to hydrocarbon ratio is about 20:1 to about 30:1 and the catalyst contact time is about 50 to about 70 seconds.

11. The process of claim 1 wherein the second riser has an upper region above the lower region and the reaction conditions in the upper region of the second riser include a temperature of about 400 to about 750 F., the catalyst to light olefinic feed ration of from about 5:1 to about 40:1 and a catalyst contact time of about 5 to about 45 seconds.

12. The process of claim 11 wherein the temperature in the upper region of the second riser reactor is about 500° to about 650° F., the catalyst to light olefinic feed ratio is about 20:1 to about 30:1 and the catalyst contact time is about 25 to about 35 seconds.

13. The process of claim 1 wherein the average particle size of the FCC catalyst is greater than that of the shape selective zeolite additive.

14. The process of claim 1 wherein the average particle size of the shape selective zeolite additive catalyst is greater than that of the FCC catalyst.

15. The process of claim 14 wherein the average particle size of the FCC catalyst is about 20 to about 150 microns and the average particle size of the shape selective zeolite additive is about 500 to about 70,000 microns, and the average packed density of the FCC catalyst ranges from about 0.4 to about 1.1 $gm/cm^3$ and the average packed density of the shape selective zeolite additive ranges from about 0.6 to about 4.0 $gm/cm^3$.

16. The process of claim 15 wherein the average particle size of the FCC catalyst is about 50 to about 100 microns and the average particle size of the shape selective zeolite additive is about 1000 to about 25,000 microns, and the average packed density of the FCC catalyst is about 0.6 to about 1.0 $gm/cm^3$ and the average packed density of the additive is about 2.0 to about 3.0 $gm/cm^3$.

17. The process of claim 16 wherein the additive is composited with a matrix material which imparts a density greater than the density of the FCC catalyst.

18. The process of claim 17 wherein additive is composited with a matrix material which possesses a coking rate which is higher than the coking rate of the FCC catalyst.

19. The process of claim 1 wherein the density of the shape selective zeolite additive is greater than the density of the FCC catalyst.

20. The process of claim 1 wherein the shape of the shape selective zeolite additive is different from the shape of the FCC catalyst.

21. The process of claim 20 wherein the average particle size of the shape selective zeolite additive is larger than the average particle size of the FCC catalyst.

22. The process of claim 21 wherein the density of the shape selective zeolite additive is greater than the density of the FCC catalyst.

* * * * *